US010011465B2

(12) United States Patent
Boos

(10) Patent No.: US 10,011,465 B2
(45) Date of Patent: Jul. 3, 2018

(54) MOBILE CRANE, SUPPORT DEVICE, AND ASSEMBLY PROCESS FOR A SUPPORT DEVICE

(71) Applicant: Liebherr-Werk Ehingen GmbH, Ehingen (DE)

(72) Inventor: Bernd Boos, Ehingen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 513 days.

(21) Appl. No.: 14/682,613

(22) Filed: Apr. 9, 2015

(65) Prior Publication Data

US 2015/0291402 A1 Oct. 15, 2015

(30) Foreign Application Priority Data

Apr. 14, 2014 (DE) ..... 10 2014 005 499

(51) Int. Cl.
*B66C 23/80* (2006.01)

(52) U.S. Cl.
CPC ..... *B66C 23/80* (2013.01)

(58) Field of Classification Search
CPC ..... B66C 23/00; B66C 23/62; B66C 23/72; B66C 23/78; B66C 23/80; B66C 25/00; E02F 9/08; E02F 9/0808; E02F 9/085; B60S 11/00; B60S 9/00; B60S 9/10; B60S 9/12; B60S 9/22; E04G 21/00
See application file for complete search history.

(56) References Cited

U.S. PATENT DOCUMENTS 3,279,622 A * 10/1966 Person ..... B66C 23/80 212/304
4,394,912 A * 7/1983 Epps ..... B66C 23/78 212/303
4,953,722 A * 9/1990 Becker ..... B66C 23/76 212/178
5,598,935 A * 2/1997 Harrison ..... B62D 49/085 180/69.1

FOREIGN PATENT DOCUMENTS

DE 689 16 909 T2 3/1995

* cited by examiner

*Primary Examiner* — Minh Truong
*Assistant Examiner* — Juan J Campos, Jr.
(74) *Attorney, Agent, or Firm* — Dilworth & Barrese, LLP

(57) ABSTRACT

This invention relates to a mobile crane with a vehicle framework and at least one support device positioned on the vehicle framework, whereby the at least one support device comprises a sliding beam box and at least one sliding beam supported therein in a telescopable manner, whereby the sliding beam box consists of a fixed partial sliding beam box and of a detachable partial sliding beam box, and whereby the fixed partial sliding beam box is firmly fixed to the mobile crane, particularly on the vehicle framework, and the detachable partial sliding beam box is detachably connected or connectable with the fixed partial sliding beam box.

15 Claims, 6 Drawing Sheets

MOBILE CRANE, SUPPORT DEVICE, AND ASSEMBLY PROCESS FOR A SUPPORT DEVICE

BACKGROUND OF THE INVENTION

The invention relates to a mobile crane with a vehicle framework and at least one support device positioned on the vehicle framework, whereby the at least one support device comprises a sliding beam box and at least one sliding beam supported therein in a telescopable manner.

Mobile cranes, because of their very nature, usually have several vehicle axles by means of which the mobile crane can be moved down a road. Because of the current legislation, a maximum axle load of 12 T is thereby permitted for road travel. As a rule, driving permits for large devices with a total weight of up to 100 T are issued relatively easily and quickly. If the total weight exceeds the limit of 100 T, however, then the expense for requesting a driving permit becomes considerably higher or no permits may be issued, as the case may be.

In order to observe the legally specified maximum weight for road travel, it is thus known to transport individual components of the mobile crane separately and to unite these with the mobile crane only at the installation point. The German patent DE 10 2008 032 739 A1 proposes, for example, the dismounting of the crane support, in order to transport it to the destination separately. The implementation proposed, however, relates to a special construction of a foldable support device with a swivellable base chest and a sliding beam that can be telescoped out from this. The support device is attached laterally to the mobile crane, and can be dismounted completely from the crane for road transport.

Furthermore, cranes are known which, instead of the foldable support, have a support integrated into the vehicle framework. This consists of a sliding beam box and a sliding beam that can be slid out of the sliding beam box. The sliding out occurs, as a general rule, perpendicularly to the longitudinal axis of the vehicle framework. In the case of large cranes with high total weight, the sliding beam is removed for the transport of the mobile crane in open road traffic, in order to thereby be able to meet the standards of open road traffic in regard to the permissible axle load, but without dispensing with the necessary support device. The advantage for load-bearing capacity is achieved at the price of increased equipment expense for the use of the crane.

In such supports, the sliding beam conveys very large support forces into the sliding beam box by means of a force couple. For the telescoping movement of the sliding beam, this is movably supported in the sliding beam box by means of support points. The bearing clearances selected, however, have to be as small as possible, in order to avoid tilting during the telescoping process. The small bearing clearance and the specific weight of the support beam, however, make the threading of the sliding beam into the sliding beam box at the installation point more difficult.

SUMMARY OF THE INVENTION

The task set for the present invention involves a further development of a mobile crane in accordance with the invention that overcomes the above-stated problems upon the installation of a support device at the installation point.

This task is solved by a mobile crane in accordance with the characteristics herein. Advantageous configurations of the mobile crane are also the object herein.

Proceeding from the basis of a mobile crane with at least one support device with a beam sliding in a telescopable manner, a novel construction design for the sliding beam box is proposed. In accordance with the invention, the sliding beam box is now designed in two parts, and is divided into at least one fixed partial sliding beam box and at least one detachable partial sliding beam box. The fixed partial sliding beam box is positioned fixed to the mobile crane, particularly on the vehicle framework, and consequently remains on the mobile crane, even during road transport. It is conceivable for the fixed partial sliding beam box to be a component of the vehicle framework or, alternatively to this, to be connected with it in a non-detachable manner, such as welded, riveted, etc., for example. Ideally, the fixed partial sliding beam box is integrated into the vehicle framework.

The detachable partial sliding beam box is detachably connected or connectable, as the case may be, with the fixed partial sliding beam box of the mobile crane. For road transport, the possibility exists for disassembly of the at least one support device, if the detachable partial sliding beam box is removed and transported separately from the vehicle. In order to observe the permissible conditions of road traffic regulations, the total weight of the mobile crane is sufficiently reduced, particularly by dismounting one or several detachable partial sliding beam boxes. In the operating position, the at least one sliding beam is accommodated both in the detachable partial sliding beam box and in the partial sliding beam box attached to the vehicle.

The fixed partial sliding beam box preferably makes possible a telescoping movement of the at least one sliding beam in a nearly horizontal direction and approximately perpendicularly to the longitudinal axis of the vehicle framework—i.e., transversely to the direction of travel of the chassis. A configuration of the at least one fixed partial sliding beam box that permits a direction of removal or insertion, as the case may be, of the at least one sliding beam that is inclined relative to the transverse axis of the vehicle, is also conceivable.

In one particularly preferred configuration of the invention, the at least one sliding beam of the mobile crane is removed upon the dismounting of the detachable partial sliding beam box. Preferably, the at least one sliding beam is movably supported by means of one or several support points on the detachable partial sliding beam box. Ideally, all support points for the telescoping movement of the at least one sliding beam are positioned on or in the area of the detachable partial sliding beam box. The above-stated complicated threading process for the installation of the support device at the installation point is thereby avoided. Instead, the installation of both separated partial sliding beam boxes proceeds in a significantly simpler manner than the threading of at least one sliding beam in the narrow bearing clearance of the sliding beam box. The installation is not only simplified, but is also less time-consuming.

The telescoping movement of the at least one sliding beam is achieved by means of at least one extension cylinder which can, ideally, be dismounted from the structure of the crane together with the detachable partial sliding beam box. When in the operating condition, the extension cylinder can be connected both with the sliding beam as well as with the fixed partial sliding beam box. In this case, the connection between the cylinder and the fixed partial sliding beam box for the dismounting of the support device must first of all be separated.

In conventional support devices with beams sliding in a telescopable manner, the maximum ejection movement of the extension cylinder used on the maximum operating position is limited. In one advantageous configuration of the present invention, the extension cylinder or its installation on the sliding beam box and/or sliding beam, as the case may be, is modified in order to achieve an enlargement of the ejection movement beyond the maximum operating position into a dismounting position. Ideally, the at least one sliding beam, in the dismounting position, no longer projects, or only projects slightly, as the case may be, into the fixed partial sliding beam box.

For the installation or dismounting, as the case may be, coupling devices for the detachable connection of the pneumatic and/or hydraulic supply of the at least one extension cylinder, as the case may be, are additionally provided with the hydraulic or pneumatic system of the crane, as the case may be. The same is applicable to any possible signal lines and/or electrical power supply lines of the support device, such as for conveying any possible sensor data to an integrated sensory system, for example.

In order to design the attachment of the detachable partial sliding beam box on the fixed partial sliding beam box to be as simple as possible, the connection is preferably implemented by means of one or several support points in the form of one or several open bolt apertures. The open bolt apertures are, for obvious reasons, provided on the fixed partial sliding beam box in order to accommodate supplementary fastening devices of the detachable partial sliding beam box, particularly to mount the same. Suitable supplementary opposing connection points are taps or bolts, as the case may be, that project out laterally on the detachable partial sliding beam box. Alternately, the open bolt apertures can also be provided on the detachable partial sliding beam box or, optionally, on both partial sliding beam boxes, as the case may be.

The support point, in the form of an open bolt aperture, makes possible a swivellable installation of the detachable partial sliding beam box, as the result of which the dismounting or installation process, as the case may be, is simplified. The one or several support points in the form of open bolt apertures can be positioned on the edge of the aperture, preferably in the upper area on the right and left edge of the aperture of the fixed and/or detachable partial sliding beam box.

Additionally or alternatively, at least one or several support points, in the form of at least one machined stopping surface for the detachable partial sliding beam box, are provided on the fixed partial sliding beam box. Such support points can likewise be provided alternately or additionally on the detachable partial sliding beam box. It is conceivable for the fixed partial sliding beam box to have, in its upper area, two open bolt apertures for the installation of one or several taps or bolts of the detachable partial sliding beam box, while one or several stopping surfaces for the detachable partial sliding beam box are provided in the lower area of the fixed partial sliding beam box. For the dismounting of the detachable partial sliding beam box, this is swivelled upwardly, in order to detach the connection on the lower support points.

In a supplemental manner, one or several mechanical safety units, preferably in the form of one or several detachable bolt connections, can be provided between the two partial sliding beam boxes.

It is particularly in the case of self-installation of the one or several support devices of the crane in accordance with the invention, that the crane support base defined by the chassis may not, under certain circumstances, be sufficient to accommodate one or several support devices by means of the crane boom. It is precisely in corresponding boom lengths, such as for the accommodation of one or several support devices of a separated transport vehicle, for example, that temporary support of the crane may be required. In one particularly preferred configuration of the invention, the crane therefore comprises one or several detachable auxiliary installation supports, which can be connected with one or several fixed partial sliding beam boxes as needed, in order to temporarily support the crane for the self-installation of the detachable partial sliding beam boxes.

In the simplest case, the one or several detachable auxiliary installation supports comprise a support cylinder, the cylinder casing of which has appropriate fastening devices for accommodation in the fixed partial sliding beam box.

In addition to the crane in accordance with the invention, the present invention comprises a support device with a sliding beam box and at least one sliding beam supported therein in a telescopable manner, whereby the sliding beam box in accordance with the invention comprises at least one fixed partial sliding beam box for fixed installation to a mobile crane, and at least one detachable partial sliding beam box that is detachably connected or connectable with the fixed partial sliding beam box.

In particular, the one or several necessary support points of the at least one beam sliding in a telescopable manner are positioned completely in the area of the detachable partial sliding beam box. The support device in accordance with the invention preferably corresponds to the support device of the crane in accordance with the invention. The advantages and characteristics of the crane in accordance with the invention described above are thereby applicable, without restriction, to the support device in accordance with the invention. A repeated explanation will therefore be dispensed with.

Furthermore, the present invention relates to a process for the installation of at least one support device on a mobile crane, particularly on the crane in accordance with the invention or an advantageous configuration of the crane in accordance with the invention, as the case may be. In accordance with the invention, it is proposed for one or several auxiliary installation supports to be mounted onto the one or several fixed partial sliding beam boxes of the mobile crane. The mobile crane can be used, for example, in road traffic with one or several mounted auxiliary installation supports, without exceeding the permissible total weight for road traffic. In particular, the installation of two auxiliary installation supports on the chassis of the mobile crane is conceivable.

By means of the mounted auxiliary installation supports, such as in the form of one or several support cylinders, for example, a support base that is temporarily enlarged relative to the chassis is achieved, so that the crane, by means of its boom, lifts one or several support devices of a separate transport device and can pass into the area of the one or several fixed partial sliding beam boxes on the vehicle framework of the mobile crane. Because of the mounted auxiliary installation supports, it is possible for the installation to work in a larger area of operation.

For the installation of the one or several detachable partial sliding beam boxes, it is conceivable for the auxiliary installation supports to be dismounted in advance. A smaller boom length is sufficient for the accommodation of the prepared detachable partial sliding beam boxes, so that the support base of the chassis is sufficient. Alternatively, the one or several auxiliary installation supports can, first of all, remain on the crane and then be successively replaced by the detachable partial sliding beam boxes.

The invention relates, furthermore, to a process for the dismounting of at least one support device of a mobile crane in accordance with the present invention or for an advantageous configuration of the invention, as the case may be. In accordance with the invention, the at least one sliding beam of a support device is moved, by means of the extension cylinder, completely beyond the maximum support position and into the dismounting position. The detachable sliding beam box can thereupon be accommodated by correspondingly defined accommodation points, preferably by means of the boom of the mobile crane. In one preferred variant of implementation of the process, the detachable partial sliding beam box accommodated is raised and swivelled upwardly, so that the lower support points detach between the fixed and detachable partial sliding beam box. For obvious reasons, one or several optional mechanical safety units are detached in advance.

The swivelling in is not absolutely necessary. The detachable partial sliding beam box can also be raised vertically.

BRIEF DESCRIPTION OF THE DRAWINGS

Additional advantages and characteristics of the invention are explained in greater detail in the following by means of one example of implementation depicted in the figures. These depict the following.

DESCRIPTION OF THE PREFERRED EMBODIMENTS

Figure 1:
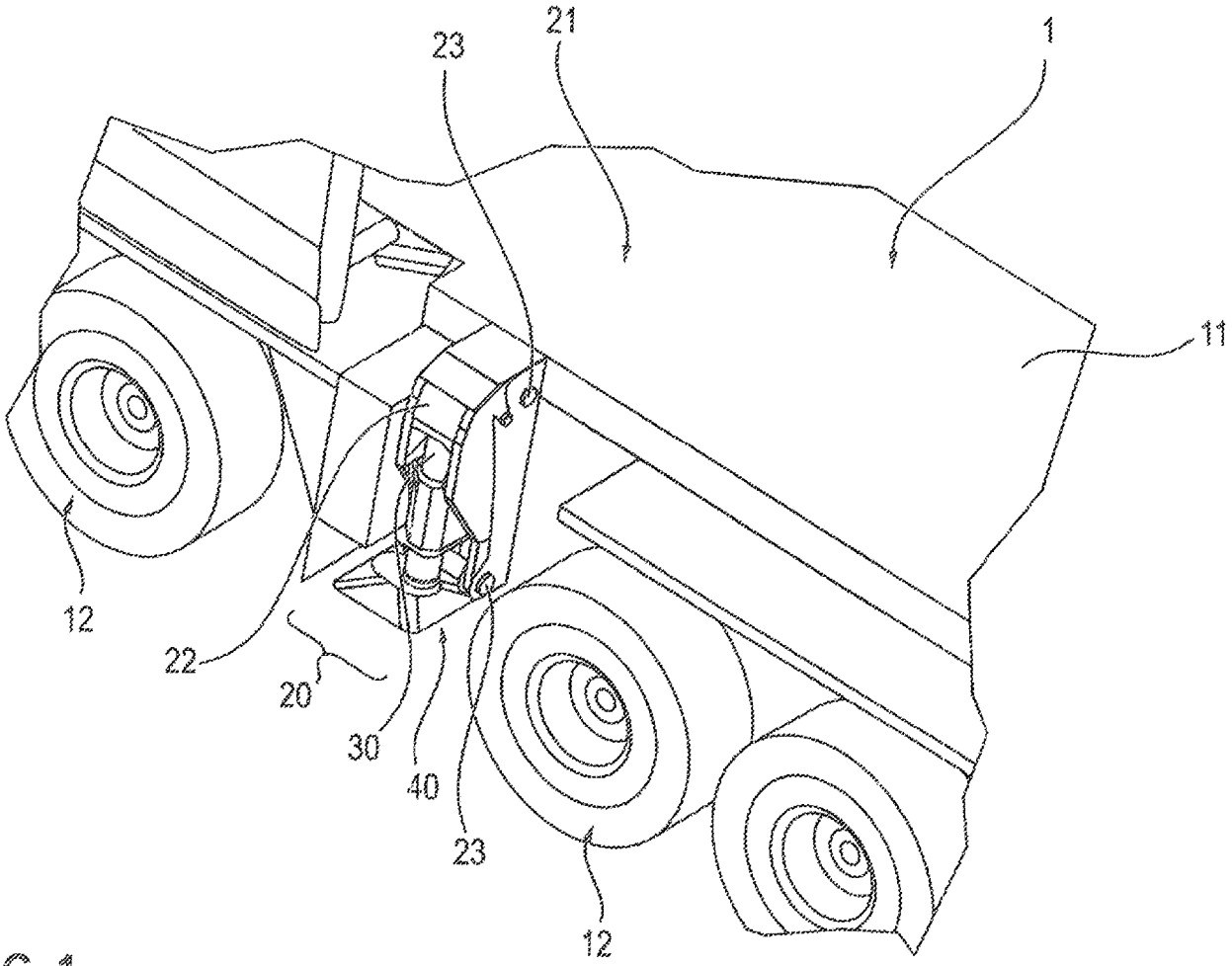
FIG. 1: A detailed perspective view of the crane in accordance with the invention with the support device in accordance with the invention.

FIG. 1 depicts a detailed section of the crane in accordance with the invention 1. A partial extract of the undercarriage of the crane with the multi-axle chassis 11 is to be noted. The number of vehicle axles 12 is not significant. For the operation of the crane, it is necessary to support the mobile crane by means of several support devices, in order to thereby minimize the danger of tipping upon larger load radii. Beams sliding in a telescopable manner, which can be laterally telescoped out in the transverse direction of the vehicle, are used as support devices. The specifically distributed positioning of the individual support devices on the vehicle is less relevant for the core concept in accordance with the invention. For example, two or more support devices can be installed on each side of the vehicle.

For the road transport of the mobile crane 1, the permissible total weight in accordance with road traffic regulations must be observed. For that purpose, certain crane components must be dismounted before leaving the construction site in order to reduce the total weight. In the mobile crane 1 in accordance with the invention, the support devices 40 are particularly suited for simple dismounting. The present invention, however, does not rule out other types of crane components from likewise being configured in a dismountable manner.

The specific construction of the support device 40 in accordance with the invention will be described in further detail by means of the detailed representations of FIGS. 1 to 4, which show an individual support device 40 in various placement positions. The construction of the support device 40 in accordance with the invention considerably simplifies the installation process at the construction site. The support device 40 comprises a two-part sliding beam box 20, which is divided into the fixed partial sliding beam box 21 and the detachable or supporting partial sliding beam box 22, as the case may be. The fixed partial sliding beam box 21 is solidly connected with the vehicle framework 11 of the mobile crane 1, and is not separated from the mobile crane for road transport.

In order to accommodate the beam 30 sliding in a telescopable manner transversely to the direction of movement in the interior, the supporting partial sliding beam box 22 comprises all support points. An extension cylinder 31 is provided as a drive for the telescoping movement, as can be inferred from the cross-sectional view of FIG. 5, for example.

The fixed partial sliding beam box 21 is integrated into the vehicle framework 11 and extends transversely to the longitudinal axis of the vehicle under the platform of the vehicle framework 11. The partial sliding beam box 21 has, in its interior, sufficient space to accommodate the sliding beam 30 inside it nearly completely. The edge of the aperture of the fixed partial sliding beam box 21 has one bolt accommodation 27, on the left side and on the right side in the upper area of the box 21, each one being formed in an open manner and with each serving as a support point 24 for the accommodation of the detachable partial sliding beam box 22 (see, in particular, FIG. 4). Machined stopping surfaces 26 which form the second support point 25 with the detachable partial sliding beam box 22 are additionally provided in the lower area of the fixed partial sliding beam box 21. The positioning of the connection and supplementary connection points can obviously also be carried out displaced relative to the implantation depicted.

The detachable partial sliding beam box 22 is configured in the form of an attachment or a cover-like unit, as the case may be, and can be placed on the box opening of the partial sliding beam box 21. In addition, the partial sliding beam box 22 has an aperture for moving the sliding beam 30 through. All placement positions for the telescopable installation of the sliding beam 30 are positioned on the detachable partial sliding beam box 22. The beam sliding in a telescopable manner 30 has, on its end side, a support cylinder in order to move the support plate in or out, in the known manner, in the vertical direction.

Figure 2:
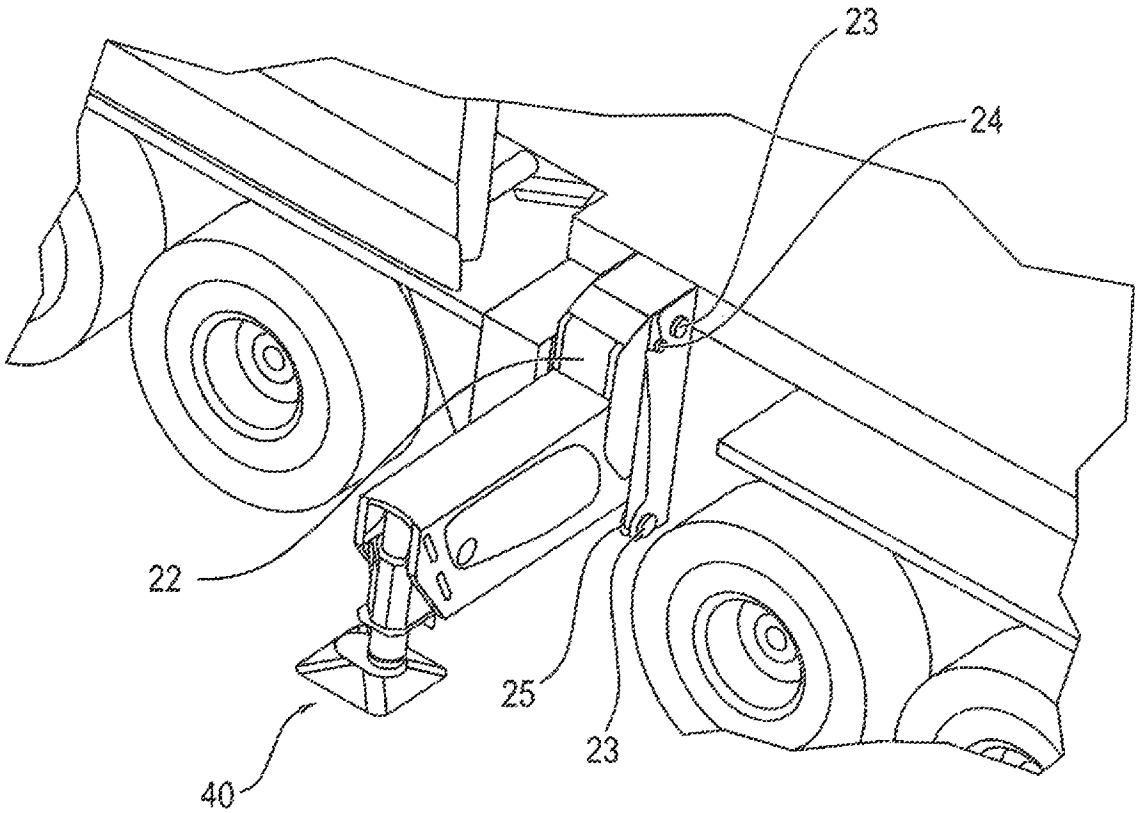
FIG. 2: The mobile crane in accordance with FIG. 1 with the sliding beam slid out.
Figure 3:
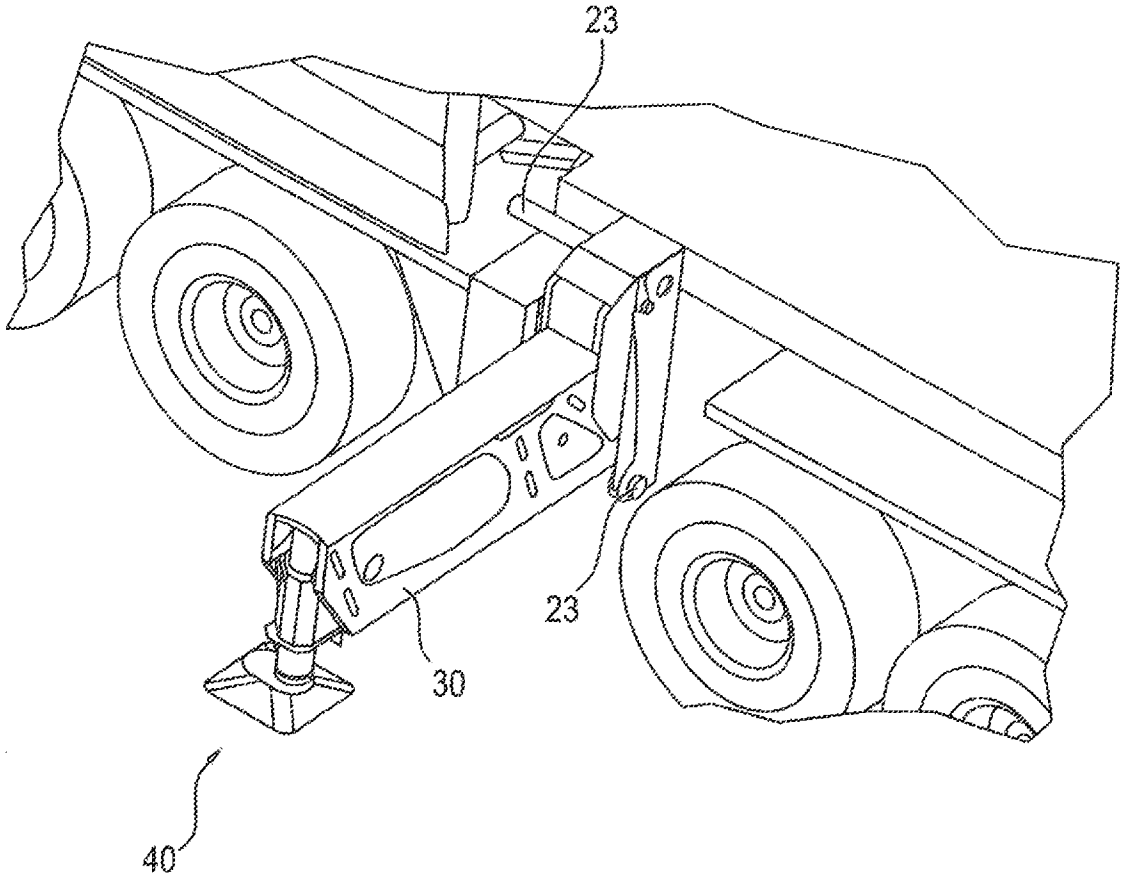
FIG. 3: The mobile crane in accordance with FIG. 1 with the sliding beam moved into the dismounting position.
Figure 4:
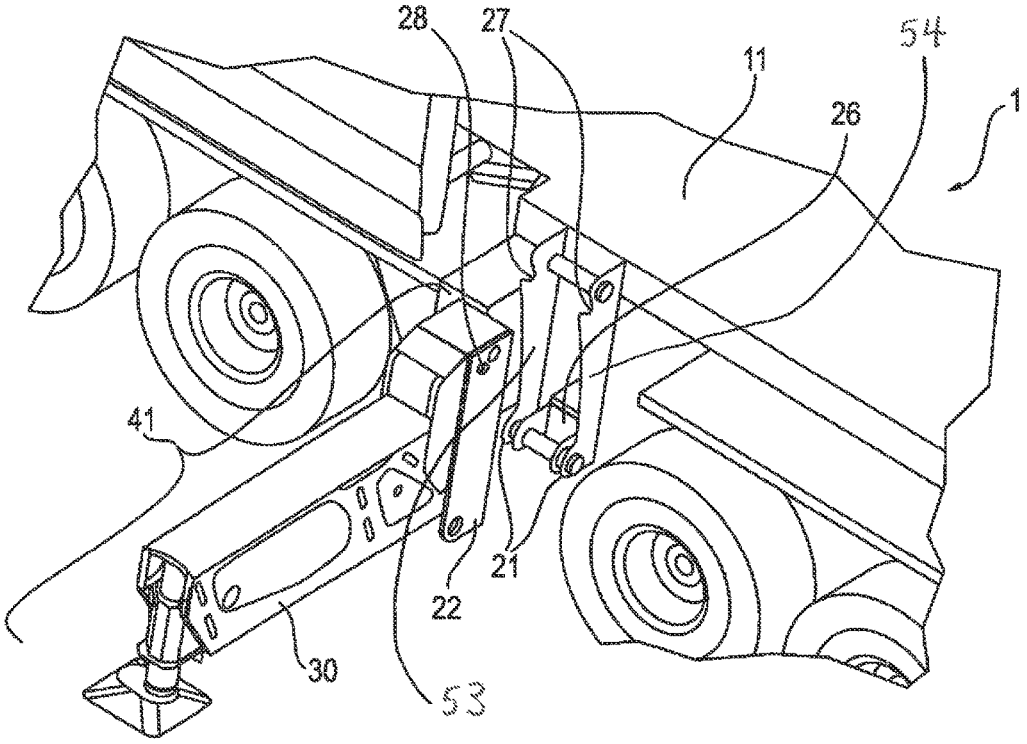
FIG. 4: The crane in accordance with the invention in accordance with FIG. 1 with the support device dismounted.

The width of the partial sliding beam box 22 is selected to be smaller relative to the partial sliding beam box 21, so that the detachable partial sliding beam box 22 is accommodated upon installation between the two perpendicular side walls of the partial sliding beam box 21 (FIGS. 1 to 3). One bolt 28, which is accommodated by the open aperture 27 of the partial sliding beam box 21 in a swivellable manner and forms the support point 24, projects laterally over the detachable partial sliding beam box 22. The lower edge of the detachable partial sliding beam box 22 engages with the contact surface 26, and thereby forms the lower support point 25.

In the mounted condition, the partial sliding beam box 22 is connected, by means of the placement positions 24, 25 described above, with the fixed partial sliding beam box 21, whereby additional mechanical safety units 23 are inserted into the upper and lower area of the sliding beam box 20.

Bolts 23 are placed as mechanical safety units in the upper and lower area of the sliding beam box in the partial sliding beam boxes 21, 22 by means of appropriate boreholes.

Figure 5:
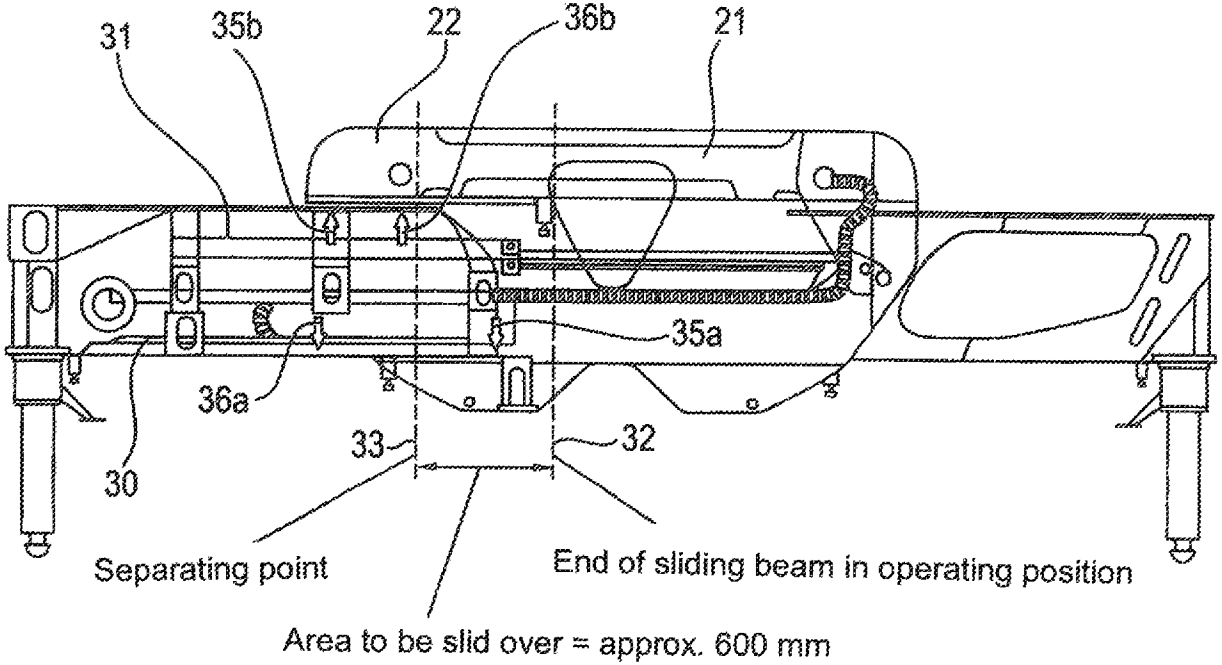
FIG. 5: A cross-sectional view through the support device in accordance with the invention.

The dismounting process of the sliding beam box 20 in accordance with the invention will be described in further detail in the following. Insofar as the mobile crane 1 is to be prepared for movement in open road traffic, the sliding beam 30 of the extension cylinder 31 is first of all slid out into its maximum operating position 32. The maximum operating position for a maximum support base is depicted in FIGS. 2, 5. After that, the extension cylinder 31 slides the sliding beam 30 further out, until the sliding beam has reached the dismounting position 33. This ejection position is visible in FIGS. 3, 5, for example. In the dismounting position, the sliding beam does not project out, or projects out only slightly, into the hollow space of the fixed partial sliding beam box 21. The additional ejection space that is necessary for that can be within a range of 400 to 800 mm, preferably 600 mm. The difference of the two positions of the sliding beam can be understood effectively by means of the cross-sectional view of FIG. 5. In order to make this additional ejection path possible, interventions at the connection points of the extension cylinder 31 are necessary under certain circumstances.

In the dismounting position depicted in FIG. 3, the extension cylinder 31 of the fixed partial sliding beam box 21 is detached and, after that, is moved completely in. As the result, it is located in the protected internal space of the sliding beam 30, in order to avoid the danger of any possible damage during transport. The supply connections between the separated support units 41, such as hydraulic, electrical, or pneumatic lines, can be separated from the detachable partial sliding beam box 22, the sliding beam 30, and the extension cylinder 31, etc., and from the supply circuits of the mobile crane 1, by means of coupling devices. Furthermore, it is necessary to draw the bolt 23, whereby the connecting placement positions 24, 25 first of all remain in engagement.

For accommodation by the mobile crane, the support unit 41 has specially attached and positioned accommodation points, on which corresponding accommodation devices are placed and on which the support unit 41 can be raised. During the raising, the connecting placement positions 24, 25 detach in a definite sequence, and the support unit 41 can be loaded onto the transport vehicle. This activity can be carried out independently by the mobile crane 1.

The position of the center of gravity of the support unit 41 relative to the accommodation points can define the sequence of detachment of the connecting support points 24, 25. The configuration of the support points 24, in the form of open bolt apertures 27, permits an upward swivelling of the support unit 41 around a horizontal axis, so that the lower placement positions 25 first of all detach. During the course of the additional movement, the support points 24 can then also separate, so that the support unit 41 is completely dismounted and can be placed on a transport vehicle. After the dismounting, the mechanical safety units 23 can be brought back into the boreholes of the detachable partial sliding beam box 22 that are provided. The installation of the support unit 41 correspondingly takes place in reversed sequence.

FIG. 5 depicts the engaging force couple 35 in the operating position. During the operation of the crane, the force 35*a* is applied directly against the fixed partial sliding beam box 21. Only the force 35*b* of the force couple 35 engages with the supporting partial sliding beam box 22. This force 35*b* is directed upwardly and is essentially displaced by the mechanical safety units 23. The second force couple 36 represents the forces arising during the dismounting situation. Both forces 36*a*, 36*b* are directed into the supporting partial sliding beam box 22. Since only the specific weight of the sliding beam 30 is to be accommodated here, the amount of acting force lies within the acceptable range.

Figure 6:
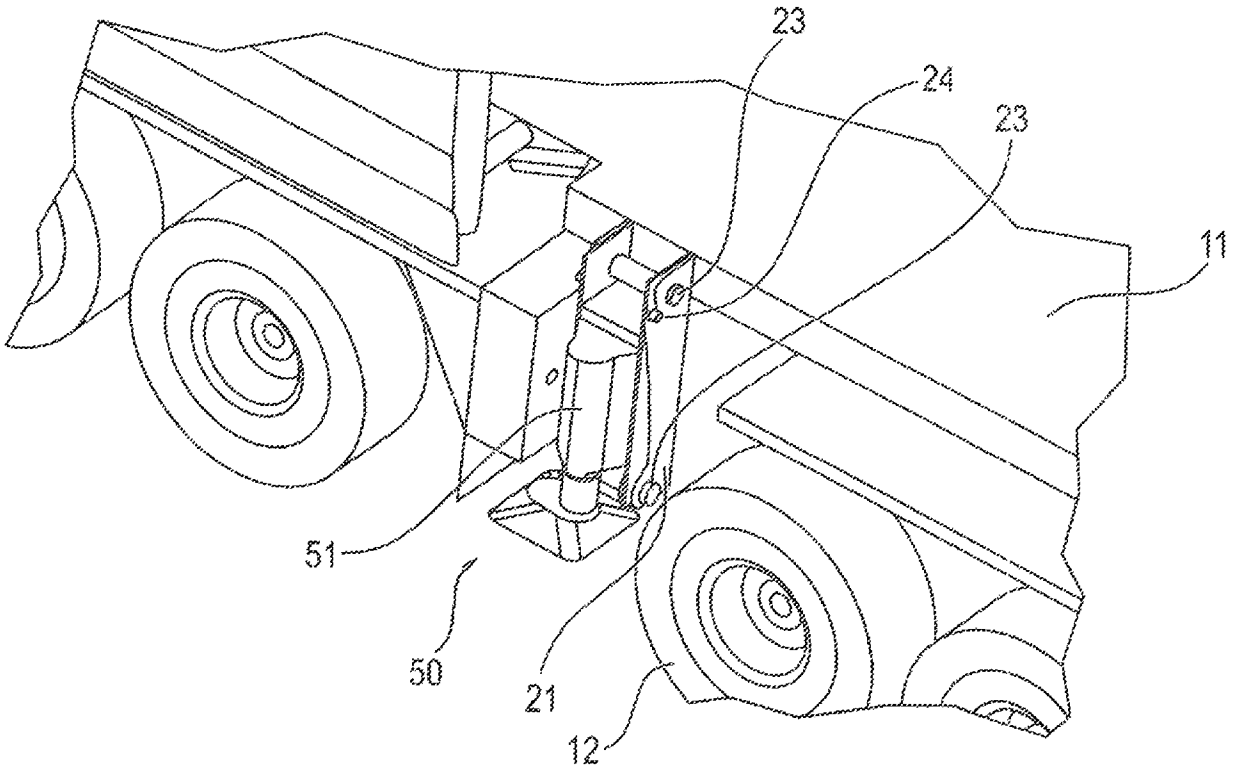
FIG. 6: The mobile crane in accordance with FIG. 1 with mounted auxiliary installation support.

During the installation and dismounting process of the support unit 41, the mobile crane 1 rests on its wheel frame 12. If all four support units 41 are dismantled, then the mobile crane 1 stands exclusively on its wheel frame 12. The soft rubber tires, however, yield under the load as soon as the upper body of the vehicle turns with its boom during the operation of the crane. Because of the yielding of the rubber tires, there is an increased danger of tipping, even if the chassis is locked. In order to provide more stability here, the connection points 24, 25 of the fixed partial sliding beam box 21 are used for the installation of auxiliary installation supports 50, such as depicted in FIG. 6.

This auxiliary installation support 50 can, in the simplest case, be a support cylinder 51, which has suitable connection points for the connecting support points 24, 25. Advantageously, two such auxiliary installation supports 50 are attached to corresponding fixed partial sliding beam boxes 21. The auxiliary installation supports 50 can remain attached to the mobile crane during road travel, or they can be transported separately, and only connected with the mobile crane 1 at the construction site.

By means of the auxiliary installation supports 50, the support base of the mobile crane is enlarged, and the boom of the mobile crane 1 can operate in a larger range, in order to bring the separately moved support units 41 of a separate transport vehicle into the area of the fixed partial sliding beam boxes 21. The boom can subsequently be shortened, and the auxiliary installation supports 50 can be removed, so that the support units 41 prepared can be mounted on the mobile crane 1 with little unloading. After installation of two support units 41, the support of the mobile crane 1 is functional, to the extent that no additional auxiliary installation supports 50 are required any longer. As shown in the various figures, e.g., FIG. 4, the fixed partial sliding beam box 21 comprises a pair of parallel flanges 53, 54 each having the open bolt accommodation 27 at an upper edge thereof, and with the contact surface 26 located between lower ends of the flanges 53, 54 as shown.

The invention claimed is:

1. A support device positioned on a vehicle framework of a mobile crane, wherein the support device comprises a sliding beam box and at least one sliding beam supported in a telescopable manner therein, the sliding beam box comprises a fixed partial sliding beam box and a detachable partial sliding beam box, the fixed partial sliding beam box is positioned fixed on the vehicle framework, the detachable partial sliding beam box is detachably connectable with the fixed partial sliding beam box, and the at least one sliding beam is mounted to be telescopable into or out of both said fixed and detachable sliding beam boxes which are fixedly mounted with respect to one another and said at least one sliding beam extends through said detachable partial sliding beam box.

2. A support device in accordance with claim 1, wherein all support points of the sliding beam supported in the telescopable manner are positioned on the detachable partial sliding beam box.

3. A support device in accordance with claim 1, wherein at least one extension cylinder is provided on the detachable partial sliding beam box.

4. A support device in accordance with claim 3, wherein the at least one sliding beam is telescopable out by the extension cylinder into a maximum operating position and, furthermore, into a dismounting position.

5. A process for the dismounting of at least one support device of a mobile crane in accordance with claim 4, wherein the extension cylinder is completely slid out into the dismounting position and the detachable sliding beam box is accommodated by one or several defined accommodation points.

6. A process in accordance with claim 5, wherein the detachable partial sliding beam box accommodated is raised and swivelled upwardly, to detach support points in a defined sequence, whereby one or several mechanical safety units is detached.

7. A support device in accordance with claim 1, wherein one or several support points in the form of open bolt apertures are provided on the fixed partial sliding beam box and/or on the detachable partial sliding beam box, to accommodate corresponding supplementary fastening devices of the detachable partial sliding beam box and/or fixed partial sliding beam box.

8. A support device in accordance with claim 7, wherein one or several support points of the fixed partial sliding beam box and/or of the detachable partial sliding beam box are configured in the form of a stopping surface for the detachable partial sliding beam box and/or fixed partial sliding beam box.

9. A support device in accordance with claim 7, wherein the open bolt apertures accommodate the supplementary fastening devices in a swivellable manner.

10. A support device in accordance with claim 1, wherein a connection between the fixed and detachable partial sliding beam boxes are mechanically secured together.

11. A support device in accordance with claim 10, wherein the fixed and detachable partial sliding beam boxes are secured together by detachable bolt connections.

12. A support device in accordance with claim 1, wherein at least one auxiliary installation support, which is detachably connectable with the fixed partial sliding beam box, is provided for the installation of the detachable partial sliding beam box.

13. A support device in accordance with claim 12, wherein the auxiliary installation support comprises a support cylinder for the accommodation by the fixed partial sliding beam box.

14. A support device in accordance with claim 1, wherein the fixed partial sliding beam box (21) comprises a pair of parallel flanges (53, 54), each said flange (53, 54) comprising an open aperture (27) on an upper end thereof, a contact surface (26) is positioned between lower ends of the flanges (53, 54) and forms a support surface (25) for the detachable partial sliding beam box (22), a bolt (28) is configured to seat in the respective open apertures (27) of said flanges (53, 54) and form a support point (24) for the detachable partial sliding beam box (22), and the detachable partial sliding beam box (22) is pivotally positioned upon the fixed partial sliding beam box (21) through the bolt (28) seating in the respective open apertures (27).

15. A support device, having a sliding beam box and at least one sliding beam supported therein in a telescopable manner, wherein the sliding beam box comprises a fixed partial sliding beam box for fixed installation on a mobile crane and a detachable partial sliding beam box, which is detachably connectable with the fixed partial sliding beam box, and the at least one sliding beam is mounted to be telescopable into or out of both said fixed and detachable sliding beam boxes which are fixedly mounted with respect to one another, and said at least one sliding beam extends through said detachable partial sliding beam box.

* * * * *